US005499786A

United States Patent [19]

Durchschlag et al.

[11] Patent Number: 5,499,786

[45] Date of Patent: Mar. 19, 1996

[54] DEVICE FOR FACILITATING THE RE-POSITIONING OF MOVEABLE RAILS OR RAIL COMPONENTS

[75] Inventors: Gerald Durchschlag; Herbert Klein, both of Zeltweg, Austria

[73] Assignee: Voest-Alpine Eisenbahnsysteme Aktiengesellschaft, Vienna, Austria

[21] Appl. No.: 135,993

[22] Filed: Oct. 14, 1993

[30] Foreign Application Priority Data

Oct. 16, 1992 [AT] Austria ..... 2044/92

[51] Int. Cl.[6] ..... B61B 7/00

[52] U.S. Cl. ..... 246/448; 246/443; 246/453

[58] Field of Search ..... 246/415 R, 430, 246/435 R, 442, 443, 447, 453, 448

[56] References Cited

U.S. PATENT DOCUMENTS

| | | | |
|---|---|---|---|
| 1,965,803 | 7/1934 | Post et al. | 246/453 X |
| 2,471,357 | 5/1949 | Smith | 246/453 X |
| 5,195,703 | 3/1993 | Kais et al. | 246/448 X |

FOREIGN PATENT DOCUMENTS

| | | | |
|---|---|---|---|
| 389851 | 10/1990 | European Pat. Off. | 246/453 |
| 2423584 | 12/1979 | France | 246/430 |
| 314265 | 7/1917 | German Dem. Rep. . | |
| 56536 | 5/1967 | German Dem. Rep. . | |
| 1056641 | 2/1957 | Germany | 246/415 R |
| 114278 | 3/1918 | United Kingdom | 246/453 |

*Primary Examiner*—Robert J. Oberleitner
*Assistant Examiner*—S. Joseph Morano
*Attorney, Agent, or Firm*—Cushman Darby & Cushman

[57] ABSTRACT

In a device for facilitating the re-positioning of moveable rails or rail components, in particular of tongue rails (7), in which the rails (7, 7'), during the re-positioning operation are supported on rollers (10, 10') forced against the underside of the rail base by spring action, the rollers (10, 10') in at least one end position (7, 7') of the re-positioning operation are pressed by the force of the spring against one edge (14, 15) of the rail base. In this way it is possible to combine the advantages of reduction of the sliding friction during the re-positioning operation with a flexible securing of the end position of the currently involved adjusted position of the moveable rail or rail component (7, 7').

8 Claims, 3 Drawing Sheets

Figures 1, 2:
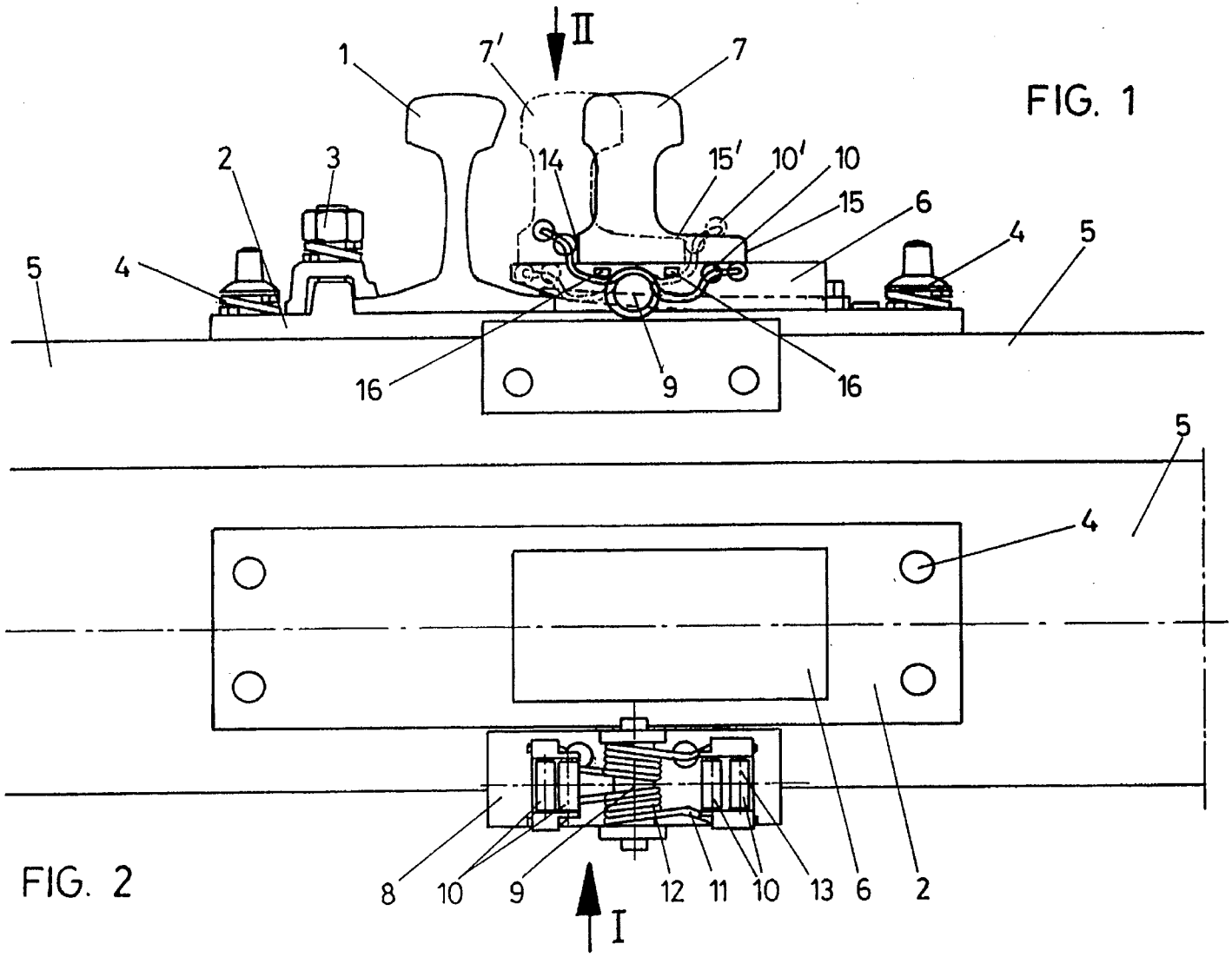

II
I
1
2
3
4
5
6
7
7'
8
9
10
10'
11
12
13
14
15
15'
16

DEVICE FOR FACILITATING THE RE-POSITIONING OF MOVEABLE RAILS OR RAIL COMPONENTS

The present invention relates to a device for facilitating the re-positioning of moveable rails or rail components, in particular of tongue rails, in which the rails, during the re-positioning operation are supported on rollers forced against the underside of the rail base by spring action.

Devices of the type referred to initially are intended to facilitate the re-positioning movement of a rail or all rail components by substituting a rolling contact in place of the sliding contact. In the case of a device of the type referred to initially which has become known from the publication DD-PS 56536, a spring-loaded roller is provided which comes into effect in the upper border region of the slide support. During the re-positioning operation it is apparently intended that the moveable portions of the rail or the moveable rail are to lifted up above the slide support to such an extent that the moveable portions of the rail or the moveable rail are exclusively moved over the roller, in which case the roller is rotated about its axis. For safety reasons, when a vehicle travels over the moveable portions of the rail or the moveable rail, support for them is provided on the upper surface of the slide support, in order to avoid over-loading of this type of roller. Such types of rollers are thus only involved during the re-positioning movement and when a vehicle is travelling over the moveable portions of the rail they must be yielding and flexible enough and, in the known case, they must be mounted in such a manner that they can be tilted against the force of a spring, so that they are moved out of functional contact.

In the case of another known device of the type initially referred to, the spring-loaded support is dispensed with. A development of a slide support has become known from the DE-PS 314 265 in which, a roller is disposed in such a manner alongside the slide support that, when there is re-positioning of the moveable portions of the rail or the moveable rail, a lifting-up of the moveable portions of the rail or the moveable rail takes place, first-of-all, by the running-up of the moveable portions of the rail onto a roller, in which case the arrangement must be such that, at the currently involved end of the displacement pathway of the rail or the rail components, they are completely out of contact with the roller and are resting on the slide support. Naturally, with the use of this type of arrangement, The re-positioning force is substantially greater at the beginning because, not only must the frictional resistance on the surface of the slide support be overcome, but also the force of gravity must be overcome in lifting-up the rail onto the roller, before the re-positioning is facilitated. Furthermore, this type of configuration must have relatively precise dimensions in order to ensure that the moveable portions of the rail or the moveable rail, in the currently-involved operation position, does not collide with the roller because this might be damaged in such a situation.

The objective of the invention is thus to provide a device of the type referred to initially with which the advantages of a reduction in the sliding friction during the re-positioning is associated with an elastic securing of the end position of the currently-involved site of the moveable portions of the rail or the moveable rail. To achieve this objective, the fundamental nature of the invention resides in the fact that the rollers, in at least one end position of the re-positioning movement, are forced by spring action against one edge of the rail base. Because of the fact that the rollers, in at least one end position, are forced by spring action against one edge of the rail base, this brings about a springy flexible locking into position, because one of the force components corresponding to the spring force in the direction of locking into position of the rail or of the rail component is directed at the outer side of the web. Based upon the springy locking into position, it is possible without difficulty, during the re-positioning, to overcome the springy resistance, in which case, at the same time after the rollers have been swung out of position on the outer side of the web of the rail, and immediately thereafter, a rolling friction can be put into effect and therewith a facilitation of the re-positioning movement.

With advantage, the configuration is designed here in such a way that a separate roller is allocated to each edge of the rail base. In this manner, the two end positions of a moveable rail or of a moveable rail component are supported elastically in a locking position and with every movement out of such a locking position there is immediate establishment of a rolling support during the re-positioning movement. In order to ensure elastic support of the end position of the rails or of the rail components involved, the configuration is advantageously designed in such a way that the rollers are articulated so that they can be pivoted around a pivot axis in a pathway in the upwards direction, over a distance which is at least one-third, and preferably one half, of the height of the rail base at its edge.

An especially simple and advantageous construction can be created by having the rollers for the different edges of the rail base mounted to pivot around one pivot axis common to both. By having such a pivot axis in common, there is a progressive locking of the rails when a vehicle is travelling over them because, in these cases, the vertical force which is acting on the other roller behaves as an additional pivoting force on the currently involved supporting roller and increases the contact pressure on the outer side of the rail base.

An especially simple construction which does not require a lot of space is essentially characterised in that the springs are formed by the helical springs arranged concentrically around the pivot axis of the rollers and their free ends are attached to the axes of the rollers and act in conjunction with stops for restriction of the pivot pathway. With this type of arrangement of the rollers with concentrically arranged helical springs, it is usually sufficient to have only one spring on the free ends of which each of the rollers can be mounted to be able to pivot parallel to the axis of the helical spring, by which means a very compact unit which can be installed subsequently is created. An additional facilitation of the re-positioning movement can be achieved by providing two rollers with their axes parallel to each other disposed on the free ends of the springs, in which case a simple subsequent installation at any desired place can be effected by having the spring members and the rollers offset to each other in relation to the slide supports or slide plates in the longitudinal direction of the rails and detachably connected to the sleepers or rails. For effectual avoidance of gaping of tongue rails in regions with an absence of closure and especially where there is a large distance between sleepers and to ensure a secure positioning of the moveable rail components involved, the configuration is advantageously designed in such a way that the spring members and rollers are arranged in or on a carrier which is adjustably connected to a claw gripping around the rail base of an immovable rail transversely to the longitudinal direction of the rail, in which case, especially when the claw gripping around the rail base is connected to the bearer by way of a spindle drive, a very simple adjustment is made possible.

With the correct layout of the inventive re-positioning aids, this allows for the moveable rail, in particular a tongue rail, to be lifted up off the slide plate during the re-positioning operation by means of the pre-stressed spring, thus substantially reducing the resistance to the movement. The re-positioning operation is bolstered by the potential spring force of the unilaterally adjacent rollers which, in this manner, are secured with springiness in their end position. The inventive configuration makes possible a simple subsequent addition to existing points, in which case the re-positioning aids are not restricted to any particular geometric conditions. It can, for example, be utilised in connection with known slide supports without any special adaptation operations. In particular, because of the flexibility of the installation of the inventive re-positioning aid, a precise guiding of the moveable rail components can be realized even when this is not forced into the correct position by means of closure-or adjustment-members. However, the spring-stressed roller device can be affixed to the sleepers, thus providing a very solid and stable support.

Figures 3, 4:
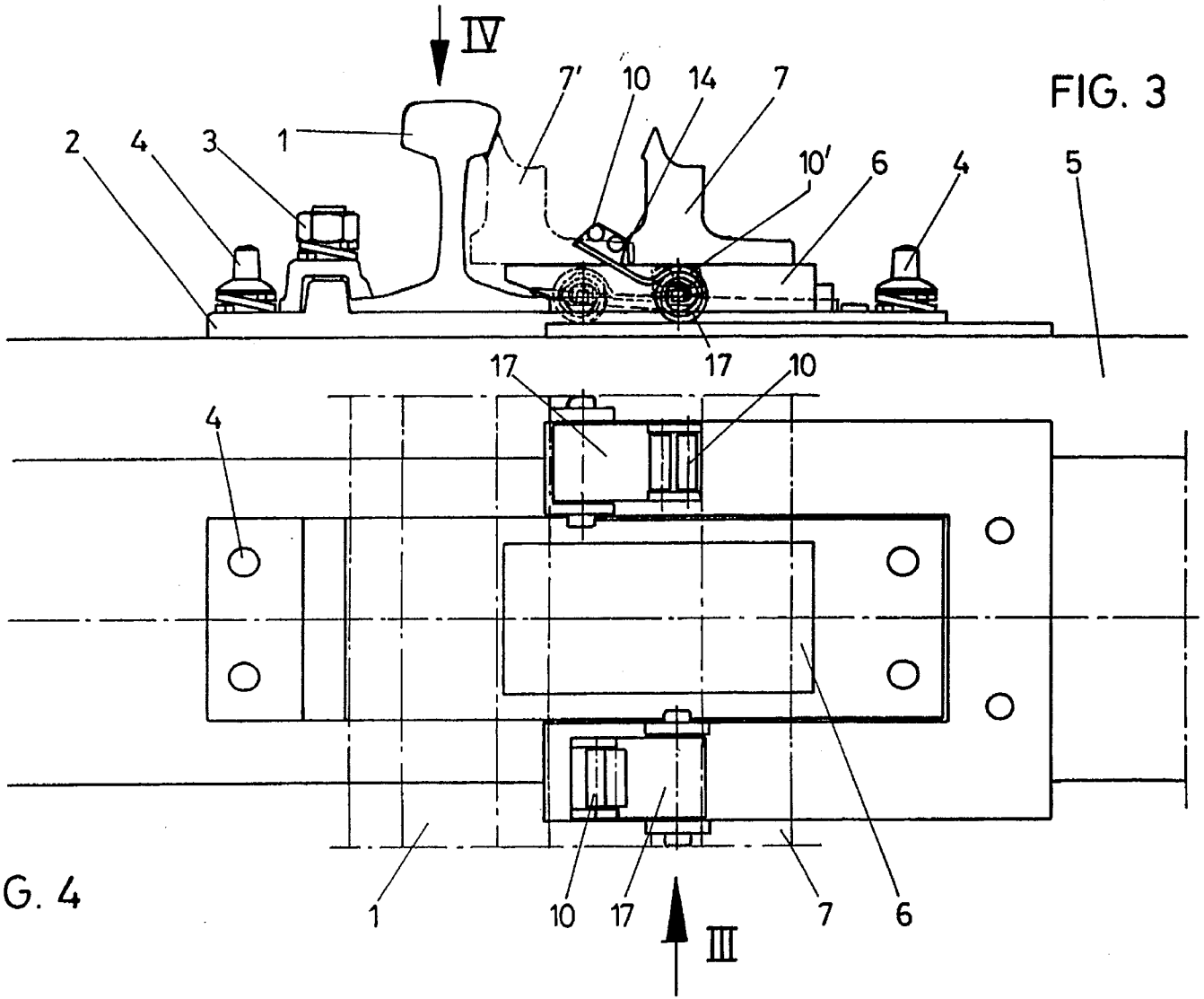
Figure 5:
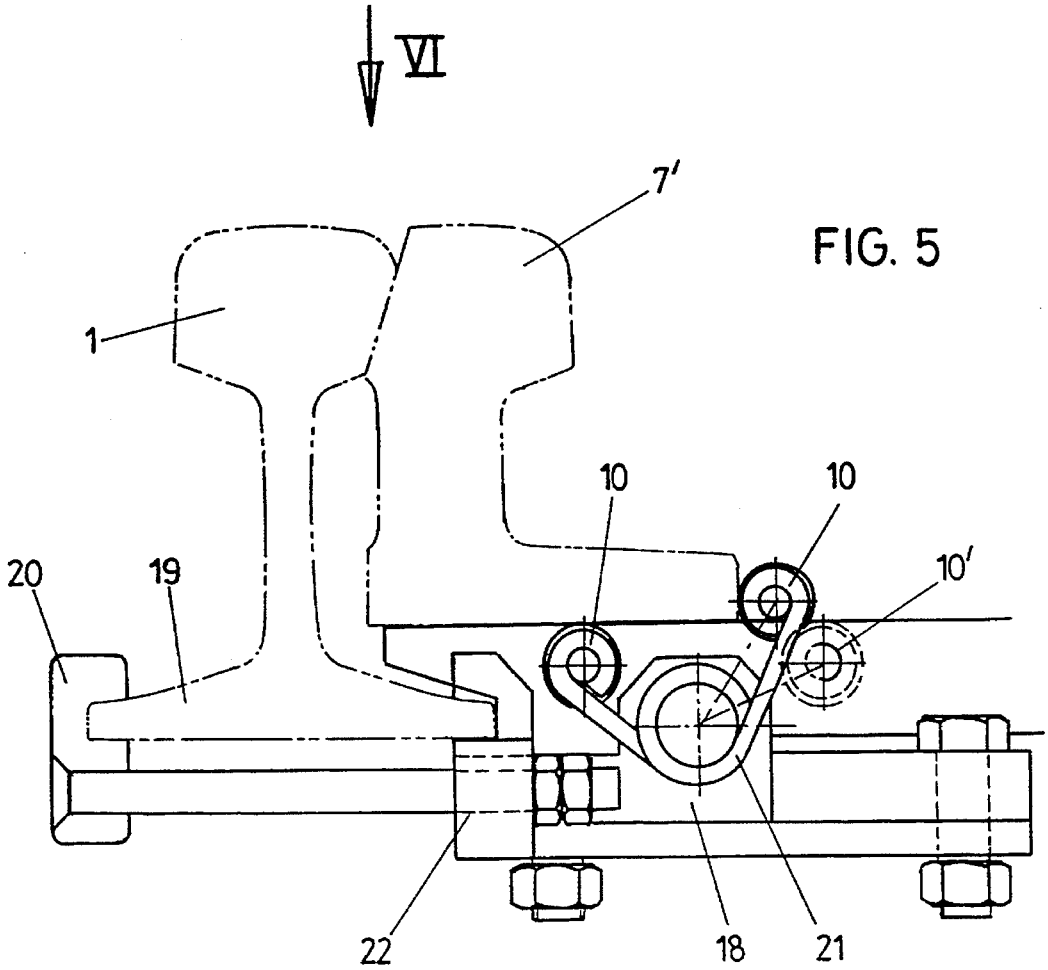
Figure 6:
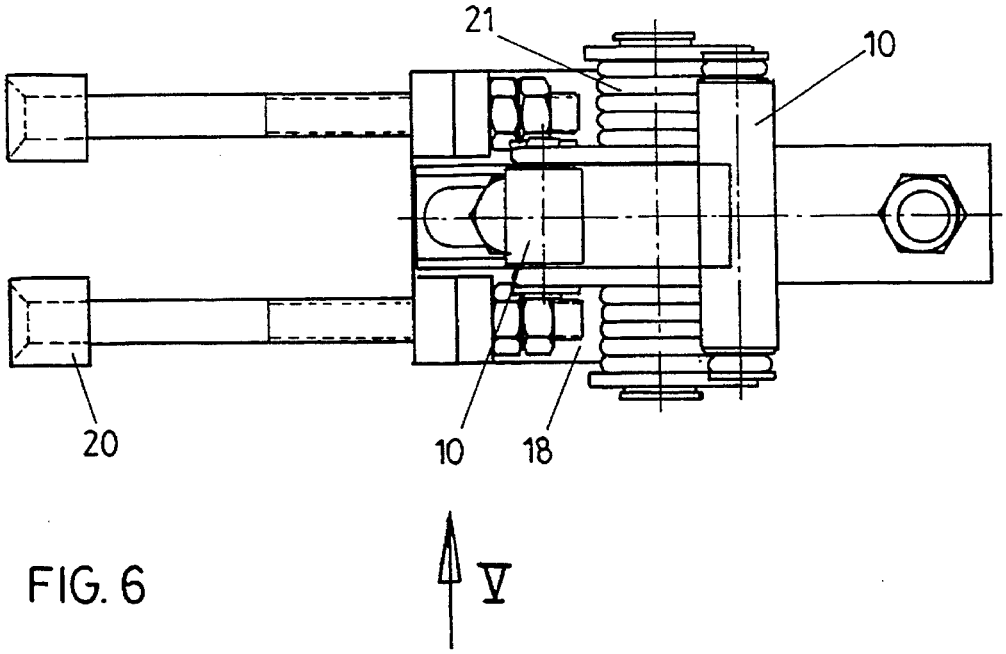

The invention will now be described in greater detail with reference to the examples of embodiment illustrated in the accompanying drawings, in which:

FIG. 1 is a side elevation of the device in accordance with the invention for facilitating the re-positioning movement of moveable rails or moveable rail components, viewed in the direction of arrow I in FIG. 2, FIG. 2 is a plan viewed in the direction of the arrow II in FIG. 1, where the rails have not been depicted for the sake of clarity, FIG. 3 is similar to FIG. 1 in side elevation of a modified embodiment, viewed in the direction of arrow III in FIG. 4, FIG. 4 is a plan viewed in the direction of arrow IV in FIG. 3, FIG. 5 is a modified embodiment as shown in FIGS. 1 and 3, on an enlarged scale, viewed in the direction of arrow V in FIG. 6, FIG. 6 is a view in the direction of the arrow VI in FIG. 5, where again the rails have not been depicted for the sake of clarity, In FIG. 1 a solid rail, in particular a stock rail, fixed immovably in position is designated as 1, mounted on a base plate 2 and held in position by a bolt 3. The base plate or slide plate 2 is also fixed in position by the bolt 4 on the diagrammatically depicted sleeper 5. A slide support 6 is mounted on the base plate 2 and there is a moveable rail, for example a tongue rail 7, mounted to slide on this slide support. Here the tongue rail 7 is depicted with solid lines in a position at a distance away from the fixed stock rail 1, whereas the tongue rail 7' shown with dot-dash lines at a point some distance away from the point of the tongue rail, is in a position doser to the stock rail.

Mounted on the sleeper 5 and the slide plate 2, as may be seen dearly especially in FIG. 2, there is a device for facilitating the re-positioning movement of the moveable rail between the positions designated as 7 and 7', in which case rollers 10 are spring mounted on a pivot axis 9 on a carrier 8., where the rollers 10 are attached to the free ends of the coils springs 12, there being two rollers 10 mounted parallel and immediately adjacent to each other on parallel axes 13.

In one of the two possible end positions of the moveable rail or the tongue rail 7, there is a pair of rollers in contact with the edge or outer edge 14 of the rail base of the moveable rail 7, whereas the other pair of rollers are held down in a depressed position by means of the rail base, as shown in FIG. 1 with solid lines for right-hand side pair of rollers 10. During a re-positioning movement by means of an adjustment drive (not depicted), the moveable rail 7 is moved from position 7 to position 7' after a pressing down of the rollers depicted on the left-hand side of FIG. 1 after a slight lifting up of the moveable rail 7 from the surface of the slide support 6, so that the moveable rail 7 is supported during the re-positioning movement by the rotatably mounted rollers 10'. In the end position 7', the rollers 10' also shown with dot-dash lines are pressed against the second edge 15' of the rail base, whereas the pair of rollers shown on the left-hand side of FIG. 1 are held down in a depressed position by the rail base.

When a vehicle travels over the rails, the moveable rail is seated directly on the surface of the slide support 6 whereas, during a re-positioning movement, a slight lifting up of the rail occurs and, in the respective end positions, the rollers 10 are pressed against the edges 14 or 15 respectively of the rail base of the moveable rail 7, thus providing support and security in the end position involved. For appropriate security of the end position, the rollers 10 can be tilted upwards through a distance which is at least one-third of the height of the edge 14 or 15 of the rail base. The tilting movement of the free arms of the coils springs carrying the rollers 10 in the upwards direction is restricted by stops 16 depicted diagrammatically.

Furthermore, the rail base in the region of transition to the edge surfaces 14 and 15 can have a rounded or chamfered configuration in order to facilitate the pressing down of the rollers 10 at the start of a re-positioning operation and to assisting in assuming the end positions.

Because of the arrangement of the device for facilitation of the re-positioning movement of moveable rails or rail components on a sleeper immediately adjacent to the slide plate, it is also possible to effect subsequent addition to an existing installation, because no additional adaptation of the components which are already installed needs to be undertaken and it is only the position of the rollers 10 on the particular endpoint involved which needs to be specifically adjusted. Because of the fact the rollers are mounted in common on the free ends of a helical spring 12, in each case this results in support for the movement by means of the pre-stressing of the free arms involved.

In the case of the embodiments depicted in FIGS. 3 and 4, the same reference numbers are retained as those used in FIGS. 1 and 2 for the same components. Once again there is a slide plate 2 affixed to the upper surface of a sleeper 5, in which case there is a slide support 6 for a moveable rail 7 mounted on said plate. The difference from the preceding form of embodiment, according to the configuration depicted in FIGS. 3 and 4, is that in each case a helical spring is provided which, here again, carries a pair of rollers 10 on each free end. The devices for facilitation of the re-positioning movement of moveable rails or rail components are here arranged on both sides of the slide support 6 in such a manner that, in each case, a device formed by the acting in conjunction of a spring 17 and the rollers 10 ensures a definite end position of the moveable rail 7 or moveable rail component 7'. During the movement of the moveable rail 7, once again there is a slight lifting up of the rail from the surface of the slide support, so that the movement takes place with only rolling friction. As depicted in FIG. 3, once again the securing of the position of the rail 7 is ensured by means of the roller 10 pressing against the side 14 of the rail base, whereas the other pair of rollers 10' is forced down in this position by the rail base. In the position 7' the securing of the end position is effected by means of the pair of rollers 10 depicted in FIG. 3 as being forced down.

Because of the separated arrangement of the rollers 10, the possibilities of adjustment and adaptation are further simplified because, with a standardized device, the position of fastening of which can be altered to correspond to the displacement pathway of the moveable rail 7, for example a tongue rail, the positioning of the roller device or re-positioning aid can be undertaken. Instead of the helical springs depicted, it is also possible to utilise leaf springs.

A form of embodiment is depicted in FIGS. 5 and 6 in which the fastening into position of the device for facilitation of the re-positioning movement is not onto a sleeper or a base plate, but instead is connected to a carrier 18 having a claw 20 which grips around the rail base 19 of an immovable rail or stock rail 1. The carrier 18 is also furnished a helical spring for example, which carries rotatable rollers on its free ends. In the end position 7' of a movable rail or tongue rail depicted, the securing is once again effected by means of the fight-hand side roller 10' shown in the drawing with dot-dash lines. This right-hand side roller 10' is shown in a position in which the rail occupies the second end position.

With this type of arrangement of a claw 20, gripping around the immovable rail, which is connected to the carrier 18 for the re-positioning aid, it is also possible, in situations where no sleeper is present, to provide appropriate securing of the moveable rail and a suitable re-positioning aid. For adaptation and adjustment of the position of the carrier 18 at the currently involved end position, it is possible to move the carrier transversely to the longitudinal direction of the immovable rail by installing conventional adjustment means between the claw 20 and the carrier 18 as indicated diagrammatically with the number 22.

The claims defining the invention are as follows:

1. A device for facilitating the repositioning of a rail having a rail base and which is moveable between first and second positions, said device comprising:

roller means forced against an underside of the rail base by the action of spring means when said rail is located between said first and second positions, said roller means being articulated to pivot whereby when said rail base is in at least one of said first and second positions, the roller means is pressed by the force of the spring so as to move in a direction above the underside of the rail base by a distance which is at least one-third of the height of the rail base and engage an edge of the rail base.

2. The device according to claim 1, wherein the roller means is articulated to pivot so as to move in a direction above the underside of the rail base by a distance which is at least one-third of the height of the rail base at its edge.

3. The device according to claim 1, wherein said roller means comprises separate rollers each of which is forced against a respective opposite edge of the rail base by said spring means when said base is in the first and second positions, and wherein the rollers are articulated to pivot about a common pivot axis.

4. The device according to claim 3, wherein the spring means comprises separate helical springs arranged concentrically about said pivot axis, each spring having a free end to which said separate rollers are respectively attached, said device further comprising stop means for limiting movement of the rollers above the underside of the rail base.

5. The device according to claim 4, further comprising a second roller attached to the free end of each of said springs, said separate and second rollers having axes parallel to one another.

6. The device according to claim 1, wherein said roller means comprises separate rollers each of which is forced against a respective opposite side of the rail base by said spring means when said base is in the first and second positions, and wherein the spring means and the rollers are offset with respect to each other in the longitudinal direction of the rail and are supported by a slide plate detachably connected to a sleeper.

7. The device according to claim 1, wherein said roller means comprises separate rollers each of which is forced against a respective opposite side of the rail base by said spring means when said base is in the first and second portions, and wherein the spring means is arranged on a carrier which is adjustably connected to a claw adapted to grip a rail base of an immoveable rail so as to permit movement of the carrier transversely to the longitudinal direction of the immoveable rail.

8. A device for facilitating the repositioning of a rail having a said base which is moveable between first and second positions, said device comprising:

roller means forced against an underside of the rail base by the action of spring means when said rail is located between first and second positions, said roller means comprising separate rollers each of which is forced against a respective opposite edge of the rail base when said base is in said first and second positions, said roller means being articulated to pivot so as to move in a direction above the underside of the rail base by a distance which is at least one-third of the height of the rail base at its edge.

* * * * *